US005435244A

United States Patent [19]

Petersen et al.

[11] Patent Number: 5,435,244

[45] Date of Patent: Jul. 25, 1995

[54] HIGH SPEED PRINTING APPARATUS

[75] Inventors: James W. Petersen, Wrentham; Milton F. Florest, Jr., South Walpole, both of Mass.

[73] Assignee: Tooling Research, Inc., Walpole, Mass.

[21] Appl. No.: 109,270

[22] Filed: Aug. 20, 1993

[51] Int. Cl.[6] ..... B41F 1/06

[52] U.S. Cl. ..... 101/316; 101/334; 101/297; 101/41

[58] Field of Search ..... 101/333, 334, 316, 41, 101/297; 400/320, 323, 328, 352, 354; 74/89.21; 403/DIG. 1

[56] References Cited

U.S. PATENT DOCUMENTS

| | | | |
|---|---|---|---|
| 2,939,321 | 6/1960 | Shovic . | |
| 3,489,020 | 1/1970 | Angst . | |
| 3,706,274 | 12/1972 | Coville . | |
| 3,752,068 | 8/1973 | Tramposch et al. . | |
| 3,756,146 | 9/1973 | Norwood . | |
| 3,771,448 | 11/1973 | Thomson et al. | 101/334 |
| 3,804,016 | 4/1974 | Maruzzi et al. . | |
| 3,891,077 | 6/1975 | Sauerbrunn . | |
| 4,044,882 | 8/1977 | Weinke et al. . | |
| 4,181,443 | 1/1980 | Hirabayashi et al. . | |
| 4,227,421 | 10/1980 | Weishew . | |
| 4,372,698 | 2/1983 | Matsushima . | |
| 4,419,931 | 12/1983 | Siegal | 101/333 |
| 4,545,549 | 10/1985 | Rundo . | |
| 4,694,747 | 9/1987 | Maruzzi . | |
| 4,706,510 | 11/1987 | Zimmer | 74/89.21 |
| 4,718,341 | 1/1988 | Bishop . | |
| 4,760,788 | 8/1988 | Maruzzi et al. . | |
| 4,805,529 | 2/1989 | Becher . | |
| 4,874,264 | 10/1989 | Suzuki et al. . | |
| 4,889,438 | 12/1989 | Forsyth et al. . | |
| 5,074,160 | 12/1991 | Kasuga | 403/DIG. 1 |
| 5,081,876 | 1/1992 | Marshall | 74/89.21 |

OTHER PUBLICATIONS

Bimba Ultran Rodless Cylinder, product brochure.

*Primary Examiner*—Edgar S. Burr
*Assistant Examiner*—John S. Hilten
*Attorney, Agent, or Firm*—John A. Haug

[57] ABSTRACT

A carriage (22.28) is slidably mounted on a pair of shafts (22.20,22.22) and moves between protracted and retracted positions. A pusher element (22.32) extends downwardly from the the carriage and has a free distal end portion (22.34) attached to a rod (22.36) of a pneumatic cylinder (22.38) which extends in a direction parallel to the longitudinal axes of the shafts. A print head support body (22.44) is pivotably attached to the pusher element adjacent the distal end portion (22.34) and has a pair of followers (22.50) extending laterally from the support body and which are received in track means (22.14) formed in side walls (22.12). The print head support body assumes a first angular orientation at a printing station (22.52) when the carriage is in the protracted position and a second, different angular orientation at an ink replenishing station (22.54) when the carriage is in the retracted position. The track has a path portion (**22.14*a*) which provides a high velocity rectilinear motion for a printing stroke during which a first magnet (22.76) mounted in the pusher element is magnetically coupled to to a second magnet (22.74) mounted in the support body. The print head assembly (22) is laterally positioned by means of a carrier (20) which is magnetically coupled to a magnet assembly (52) slidably received within a tube (16) of non-magnetic material. A timing belt (38) moves the magnet assembly and, concomitantly the carrier, to a selected transverse position between two housings (12,14**).

10 Claims, 8 Drawing Sheets

HIGH SPEED PRINTING APPARATUS

This application contains subject matter also disclosed in coassigned copending U.S. application Ser. No. 08/109,530, filed on even date herewith.

BACKGROUND OF THE INVENTION

This invention relates generally to apparatus for sequentially printing a message or code on a work piece and more particularly to such apparatus for moving a print head between a first position at a first orientation to a second position at a second, different orientation.

Moving a print head between inking and marking positions utilizing a fixed cam track with the print head having a first orientation at one end of the track where its ink supply is replenished and a different angular orientation at the other end of the track where it is brought into printing engagement with work piece is known. An example of this type mechanism is shown in U.S. Pat. No. 4,760,788. Typically, such mechanisms employ a print head support which mounts cam followers captured in the cam tracks and are caused to slide in the tracks as kinetic linkages move the print head support between the ends of the track. The sliding motion results in friction with concomitant wear and requires that the parts be relatively loose. This results in a mechanism in which the print head support is relatively unstable and adversely affects the quality of the printed characters on the work piece with regard to sharpness or definition. That is, due to the looseness of the print head support the printed characters tend to be fuzzy. The mechanism also tends to be noisy and gets nosier as the parts wear. The fuzziness of the printed characters also increases with wear of the parts. Further, due to friction and the looseness of parts with the forces impacting through the linkages the useful life of such mechanisms is relatively short.

SUMMARY OF THE INVENTION

It is an object of the present invention to provide a mechanism for moving a print head between an ink supply or replenishing station at a first angular orientation to a printing station at a second, different, angular orientation which is free of the prior art limitations mentioned above. Another object is the provision of an improved printing apparatus which is quiet in operation, has a long useful life and one which provides sharp, clear printed characters on a work piece.

Briefly, in accordance with the invention, a carriage is movably mounted to slide on a pair of shafts between protracted and retracted positions. A pusher element depends downwardly from the carriage and has a distal end portion connected to the rod of a pneumatic cylinder which is oriented in a direction parallel to the longitudinal axes of the pair of shafts. A print head support body is pivotably mounted to the pusher element adjacent the free distal end and follower means extending laterally from the support body are received in tracks formed is side walls on either side of the support body. The print head has a first angular orientation at the printing station when the carriage is at one extremity and a second, different, angular orientation at the ink replenishing station when the carriage is at the opposite extremity. According to a feature of the invention the track is formed with first, second and third path sections with the first path section used to lift the support body from the ink supply, the second path section used to change the angular orientation of the support body and the third path section used to move the support body through a rectilinear printing stroke at a relatively high velocity. According to another feature of the invention the follower is provided with rotatable, low friction tires adapted to roll within the tracks to minimize friction and noise. According to another feature of the invention a first magnet is mounted on the pusher element and a second magnet is mounted in the support body such that when the support body assumes the printing angular orientation the magnets move into close magnetic coupling effectively locking the elements together thereby stabilizing the print head. According to yet another feature of the invention the print head assembly is mounted on a carrier which in turn is slidably mounted on a tube extending between first and second housings. The carrier is magnetically coupled to a magnet assembly within the tube which is attached to a timing belt which is trained through the tube to a housing, around timing pulleys and through another tube to the other housing, around the pulleys and back through the first tube to the other side of the magnet assembly. The timing belt is caused to be moved by a timing motor so that the carrier will assume a selected transverse position. According to a feature of the invention the belt is provided with elements which cooperate with sensors to provide means for determining the precise location of the magnet assembly and concomitantly, the carrier. The housings and tubes are sealed so that the system can be thoroughly washed down.

These together with other objects and advantages which will become subsequently apparent reside in the details of construction and operation as more fully hereinafter described and claimed, reference being had to the accompanying drawings forming a part hereof, wherein like reference numerals refer to like parts throughout.

DETAILED DESCRIPTION OF THE PREFERRED EMBODIMENTS

Figure 1:
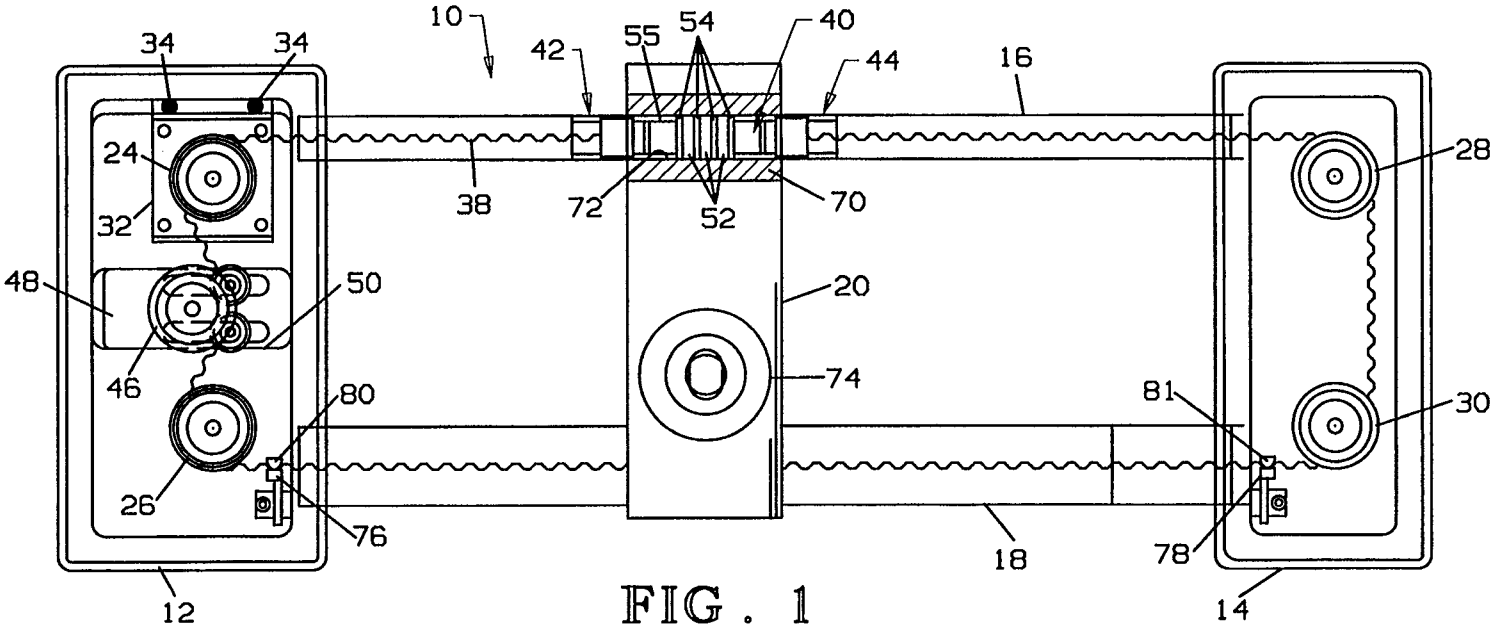
FIG. 1 is a front elevational view of a linear positioning system made in accordance with the invention shown with cover plates of the housings removed for purposes of illustration and shown with a portion of the carriage in cross section.
Figure 2:
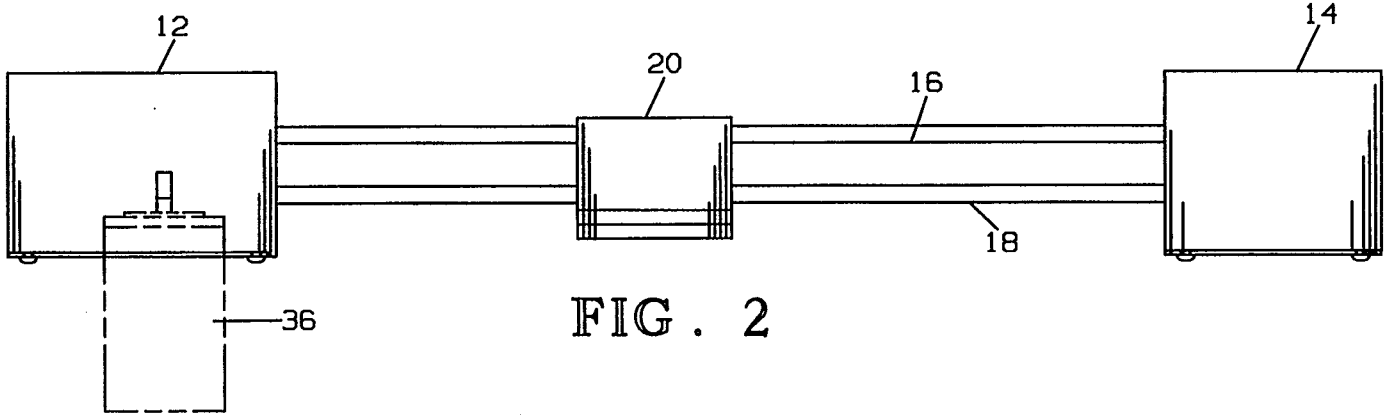
FIG. 2 is a top view of the FIG. 1 system.
Figure 3:
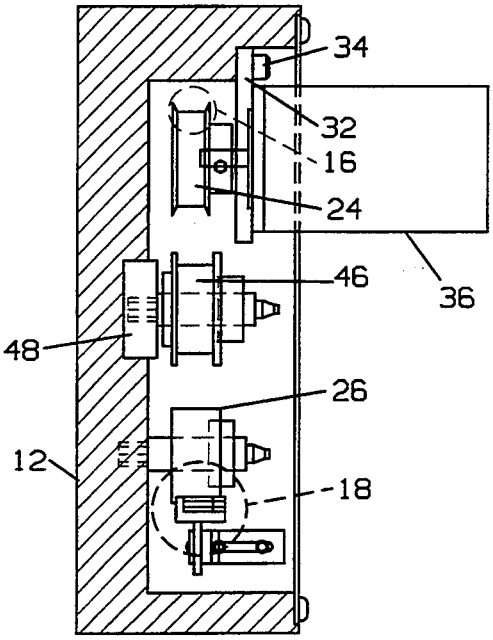
FIGS. 3 and 4 are cross sectional views taken through respective housings.
Figure 4:
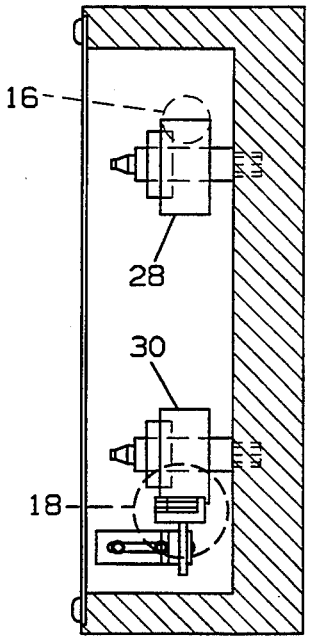
Figure 5:
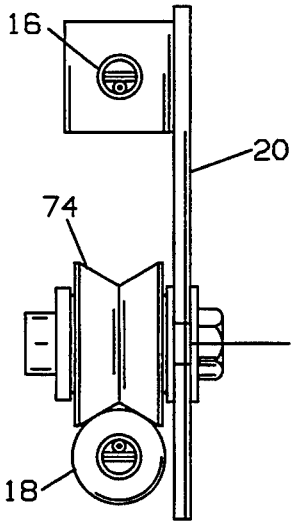
FIG. 5 is a side view of the carriage including a cross sectional view of the tubular track on which the carriage is mounted.

Traversing System 10 made in accordance with the invention comprises first and second spaced housings 12, 14 formed of any suitable material, such as aluminum, with first and second tubes 16, 18 extending in a direction parallel to one another between the two housings and in communication with the interior of the housings. Tube 16 is formed of non-magnetic material, such as stainless steel while tube 18 can be formed of any suitable material, stainless steel being suitable. A carriage 20, movably mounted on tubes 16, 18 is adapted to slide to selected transverse positions between housings 12, 14 and is adapted to mount thereon any of a variety of tools, such as a print head 22 to be discussed below, which it is desired to position at various selected transverse positions between the housings in order to perform work on a work piece. For example, printing a suitable code on work pieces moving along a conveyor line adjacent to the traversing system. The carriage, as will be explained in detail infra, can be programmed to move to a particular location so that print head assembly 22 can come into printing engagement with work pieces intermittently presented at the printing station.

First and second timing pulleys 24, 26 are mounted in housing 12 aligned with respective tubes 16, 18 and third and fourth pulleys 28, 30 are mounted in housing 14 aligned with respective tubes 16, 18. A mounting plate 32 is attached to housing 12 as by using conventional fasteners. Mounting plate 32 in turn mounts a motor 36 which is coupled to pulley 24. Motor 36 may be a stepping motor or a servo motor as will be explained below.

A timing belt 38 has one end attached to magnet assembly 40 as shown at 42 with the belt extending through tube 16 into housing 12, around drive pulley 24, pulley 26, through tube 18 into housing 14, around pulleys 30 and 28 and back into tube 16 and is attached at its opposite end to magnet assembly 40 at 44. A belt tensioning pulley 46 is mounted in housing 12 transversely adjustable to maintain belt 38 at a suitable tension. Pulley 46 is mounted on a plate 48 which is slidable toward and away from tubes 16, 18.

Figure 6:
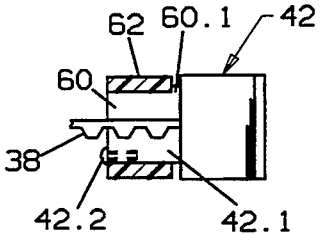
FIGS. 6 and 7 are front and side views of the belt coupling mechanism.
Figure 7:
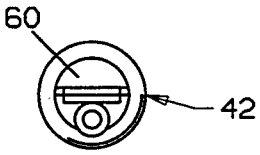

Magnet assembly 40 comprises a plurality of magnets 52 interspersed with ferromagnetic material, eg steel, washers 54 attached to tubular bearing 55 formed of suitable low friction plastic such as Delrin, a trademark of E.I. Du Pont de Nemours & Co. for thermoplastic resin, and coupling pieces 42, 44. Coupling piece 42 has a mounting portion 42.1 projecting axially from a main body portion. Sleeve 62, also formed of suitable low friction material such as Delrin, is received on mounting portion 42.1 and locked in place by the head of a threaded fastener 42.2. As seen in FIG. 6 belt 38 is attached to coupling piece 42 by a suitable wedge 60 received in sleeve 62 and locked in place by a flange 60.1 which interlocks with sleeve 42. A similar arrangement is provided for coupling piece 44.

An external magnet 70 formed with a bore 72 is mounted on carriage 20 and slidably receives tube 16 in bore 72. A guide wheel 74 is mounted on carriage 20 and is received on tube 18 to maintain carriage 20 properly oriented with respect to housings 12, 14. Magnet assembly 40 and external magnet 70 are magnetically coupled so that they move together as a single unit. That is, when motor 36 causes belt 38 to move thereby causing magnet assembly 40 to move transversely within tube 16, carriage 20 will move along with assembly 40.

Proximity switches 76.78 are mounted in respective housings 12, 14 and are responsive to one or more metallic elements 80, 81 attached to belt 38. Metallic pieces 80, 81 can be conveniently clipped onto timing belt 38 at any selected location. Switches 76, 78 sense whenever metallic elements 80, 81 come into alignment with the switches and generate an electrical signal which is provided to a suitable programmable logic controller, PLC, not shown, indicating that the carriage is at a particular location, eg, at a home position at one end of its stroke.

In operation the drive motor receives a signal from the PLC controlling rotation of a timing belt pulley which in turn moves the timing belt 38 back and forth within the tubular tracks 16, 18 and housings 12, 14. Magnet assembly 40 is moved along with timing belt 38 which in turn, through the magnetic coupling, moves carriage 20 to selected transverse positions between housings 12, 14.

The linear positioner is a completely sealed, water tight assembly and is particularly advantageous for use in clean rooms, dirty or damp areas and can even be used in underwater applications. The transverse position of carriage 20 can be precisely controlled to within approximately 0.001 inch.

Figure 5A:
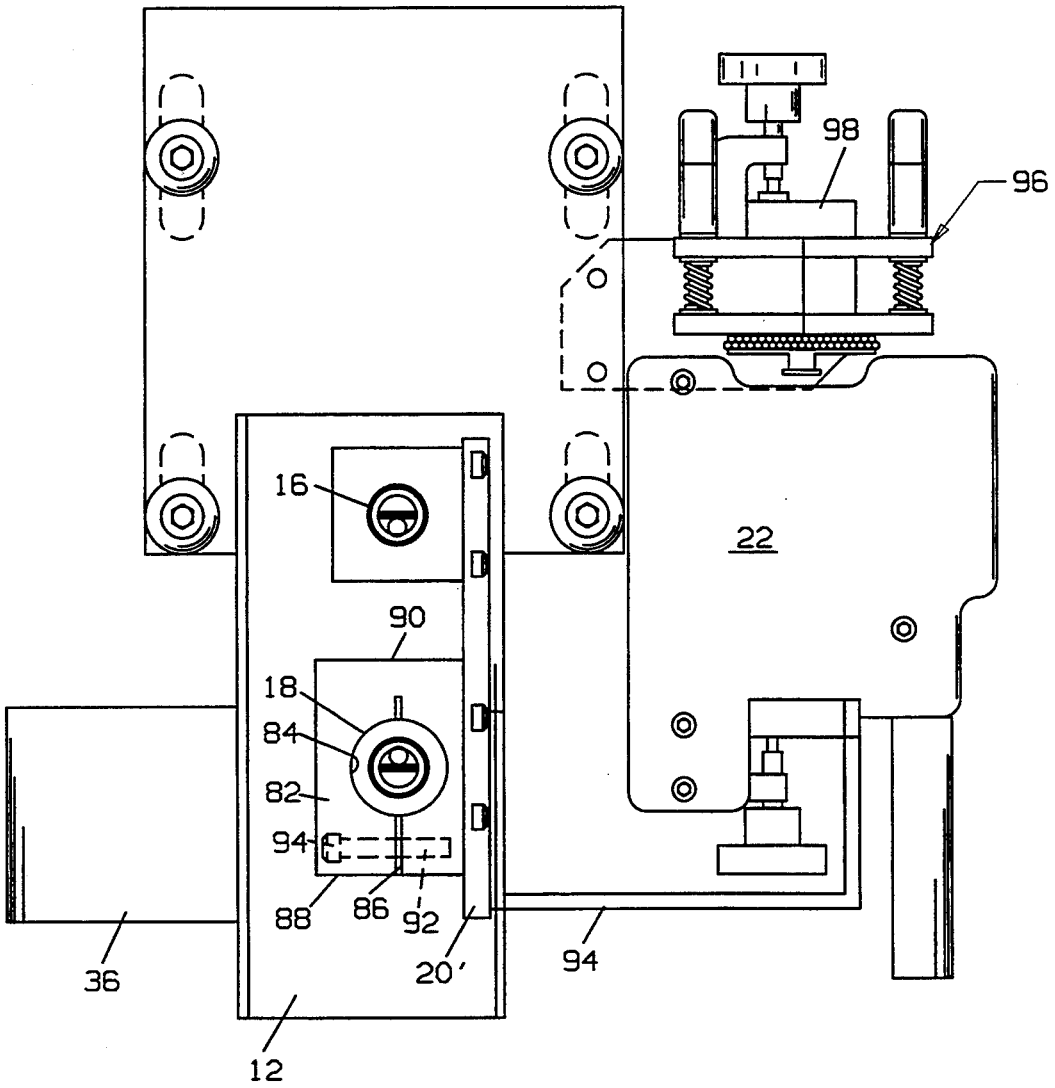
FIG. 5*a* is a side view of a modified embodiment of the FIG. 1 carriage shown with a printing device mounted thereon.

In FIG. 5*a* a modified embodiment of the carrier 20' is shown in which a plastic block 82 is provided with a bore 84 which slidably receives tube 18. Block 82 is provided with a slot 86 which extends from a lower end surface 88 through bore 84 to a point spaced from the upper surface 90 forming a hinge portion. A threaded member 92 is placed between the two split ends of block 82 with a nut 94 locked in one split end so that rotation of threaded member 92 will adjust the effective size of bore 84. This provides a very quiet, stable traversing mechanism.

Also shown in FIG. 5*a* is a printing device 22, to be explained in detail below, mounted on carriage 20' via a bracket 94 and adapted to move to selected transverse positions between housings 12, 14 along with carriage 20'. A platen 96 can be mounted on a bar 98 adjacent the printing station for use with labels or other flexible work pieces, for example.

Although one arrangement of timing pulleys has been described it is within the purview of the invention to use various drive pulleys, stepping or servo motors and the like to move belt 38 in a precise and controlled manner.

Figure 10:
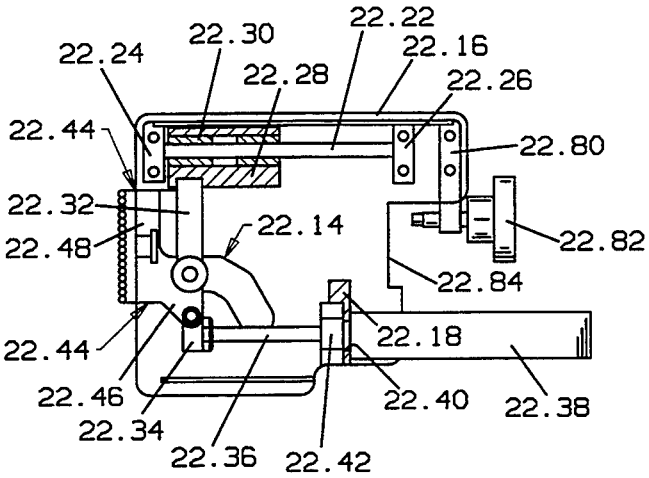
FIG. 10 is a side view of the FIGS. 8 and 9 printing device shown with a side wall removed for purpose of illustration and shown with the print head at the printing station.
Figure 11:
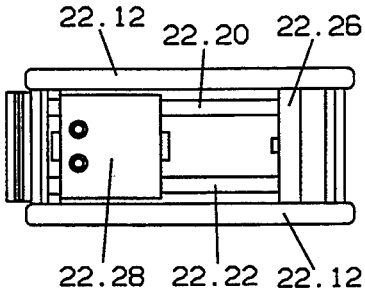
FIG. 11 is a top view of the FIGS. 8, 9 printing device shown with the top wall removed for purposes of illustration.

Print head assembly 22 comprises a housing 22.10 formed of any suitable material, such as aluminum, having first and second side walls 22.12 formed with a mirror image track in each side wall aligned with and facing each other. Track 22.14, for a purpose to be explained below, is generally C-shaped having three generally straight sections 22.14*a*, 22.14*b*, and 22.14*c* and is preferably channel shaped having a bottom surface portion. Walls 22.12 are spaced from one another by a top wall 22.16 and a pneumatic cylinder mounting wall 22.18 extending between walls 22.12. First and second shafts 22.20, 22.22 (see FIGS. 10 and 11) extend parallel to one another between spaced wall portions 22.24, 22.26 also extending between side walls 22.12 adjacent top wall 22.16. Carrier element 22.28 mounts thereon a pair of bearings 22.30 (one being shown in FIG. 10) which are slidably received on respective shafts 22.20, 22.22 and a downwardly extending pusher element 22.32. Pusher element 22.32 has a free distal end portion 22.34 which is attached to rod 22.36 of a double acting pneumatic cylinder 22.38. Cylinder 22.38 is received through a bore 22.40 in wall cylinder mounting wall 22.18 and locked thereto by suitable means such as a nut 22.42 threadably received on an end portion of the cylinder housing.

Figure 19:
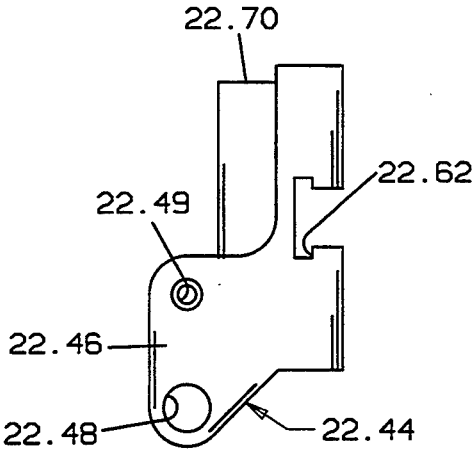

A print head support 22.44 has a pair of spaced bosses 22.46 extending from a print plate mounting body 22.48. Pusher element 22.32 is pivotably attached to bosses 22.46 at 22.48 (FIG. 13) and, in turn, bosses 22.46 have a pair of cam follower members 22.50 mounted in and extending out of bores 22.49 (FIG. 19) in bosses 22.46 which are received in track 22.14. Cam follower members 22.50 preferably are adapted to roll within track 22.14 and can be provided with a low friction tire roller portion made of suitable material such as Delrin plastic.

Figure 8:
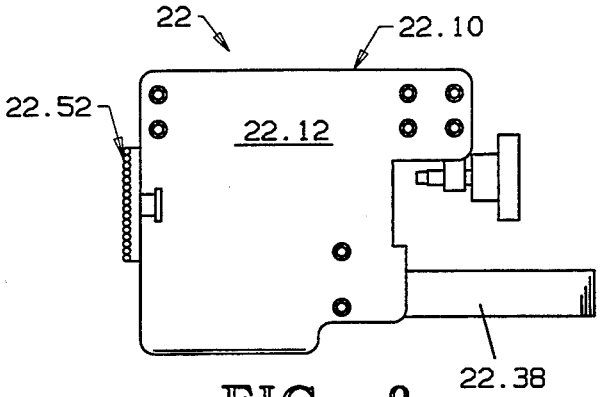
FIGS. 8 and 9 are side and front views respectively of a printing device made in accordance with the invention.
Figure 9:
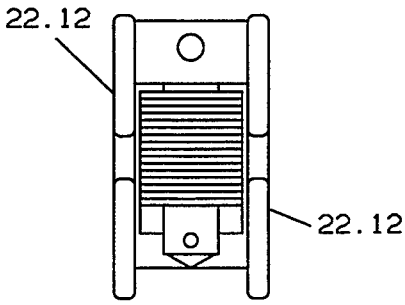
Figure 12:
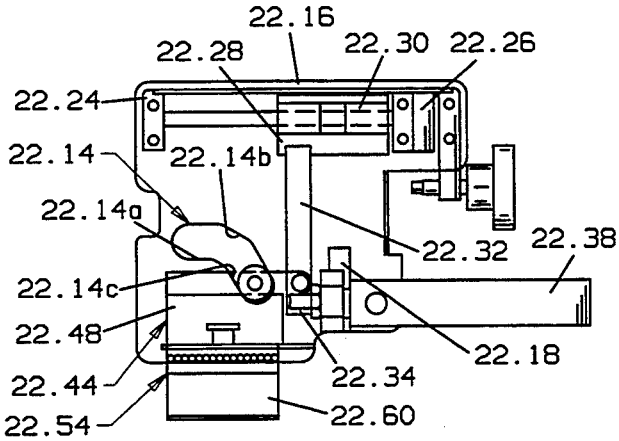
FIG. 12 is a view similar to FIG. 10 but with the print head shown at the ink replenishment station.

Housing 22.10 has a front, printing station at 22.52 (FIG. 8) and a bottom ink replenishing station at 22.54 (FIG. 12) with the print head adapted to move between these two stations in response to the stroking of cylinder rod 22.36.

Pneumatic cylinder 22.38 is mounted in housing 22.10 so that rod 22.36 moves in a direction which is parallel to the longitudinal axes of shafts 22.20, 22.22 moving pusher element back and forth on shafts 22.20, 22.22. Additionally, section 22.14*a* of track 22.14 extends in a direction parallel to the longitudinal axis of cylinder rod 22.36 to provide increased velocity in the final printing stroke at station 22.52 as will be explained in greater detail below.

Figure 21:
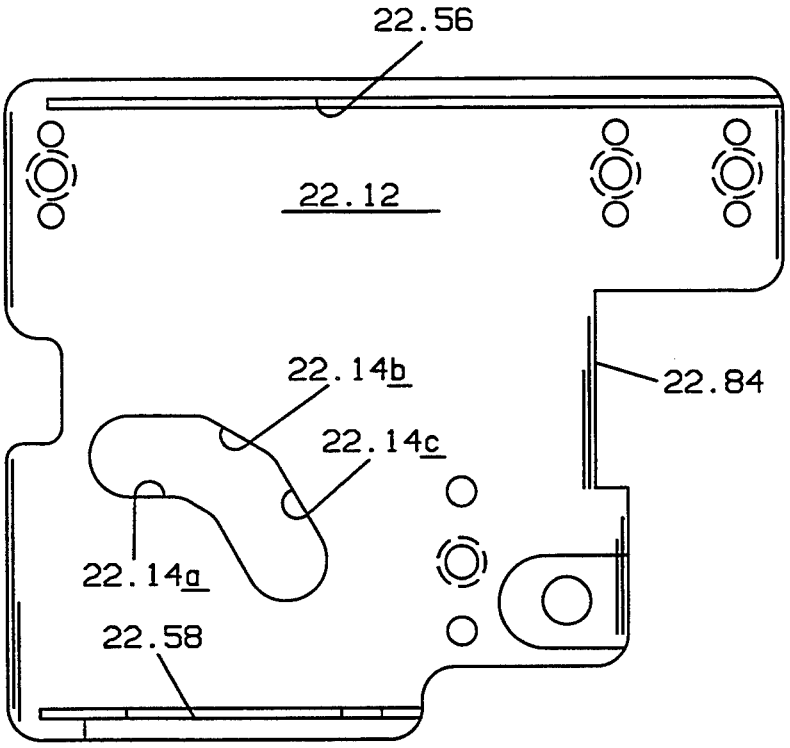
FIG. 21 is a side view of one of the side walls of the printing device showing details of the cam track; and FIGS. *22a*, *22b*, *22c*, *22d*, *22e*, *22f*, *22g*, *22h*, *22i*, *22j*, *22k*, *22l*, *22m*, *22n* and *22o* show symbolic views of the print head support and print head in sequential positions as the cam follower moves from one extremity of the cam track to the opposite extremity.

Side walls 22.12, see in particular FIG. 21, is formed with an upper groove 22.56 which extends along the top surface of side walls 22.12 in each top portion for reception of cover member 22.16 as well as a groove 22.58 adjacent the bottom portion and extending parallel with the bottom surface portion of side walls 22.12 for reception of ink cup 22.60 at ink replenishing station 22.54.

Figure 13:
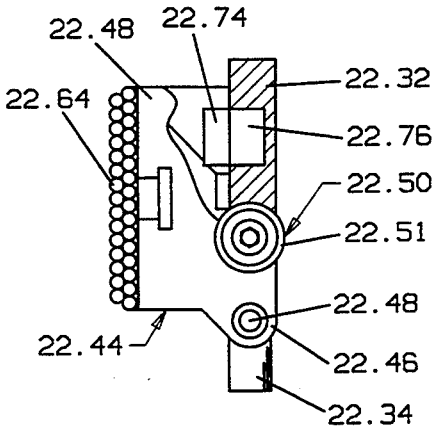
FIG. 13 is an enlarged side view, partly in cross-section, of the print head when at the printing station.
Figure 14:
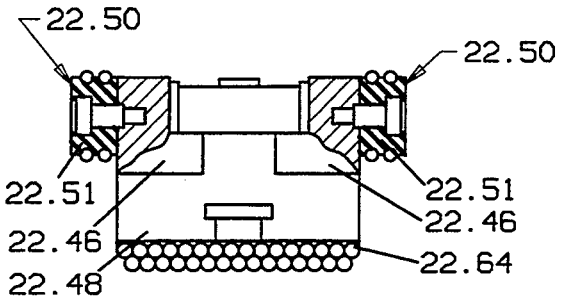
FIG. 14 is an enlarged top view, partly in cross-section, of the print head when at the printing station.
Figure 15:
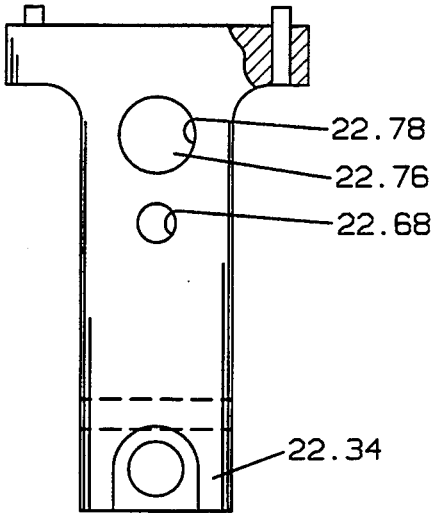
FIG. 15 is a front plan view, partly in cross-section, of a pusher element used in the FIGS. 8, 9 device.
Figure 16:
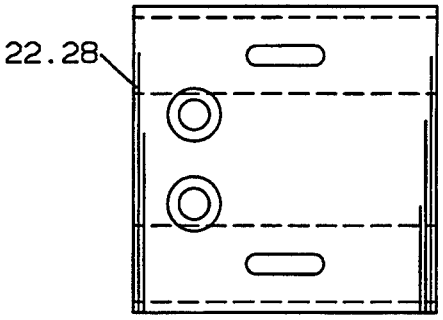
FIGS. 16 and 17 are top and side views respectively of a carrier element which is adapted for connection to the pusher element, FIG. 17 being partly in cross-section.
Figure 17:
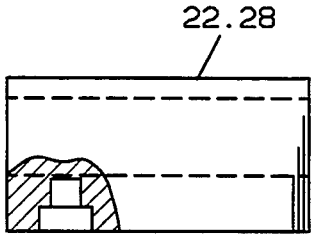
Figure 18:
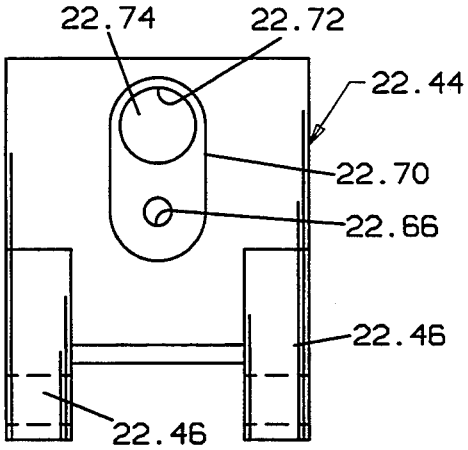
FIGS. 18, 19 and 20 are rear, side and top views respectively of the print head support, FIG. 20 being shown partly in cross section.
Figure 20:
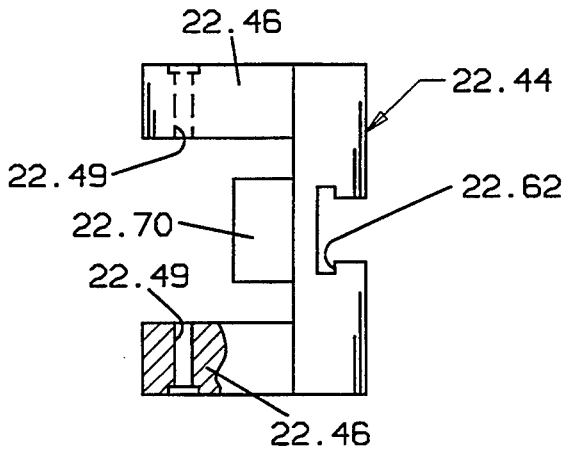

Print head support 22.44 has a print head mounting slot 22.62 (FIGS. 19 and 20) for reception of print head 22.64 having a selected code or message thereon for placement on articles which are sequentially and intermittently presented at the printing station 22.52 by means of a suitable conveyor or the like, not shown. Print head 22.64 is fixed in place by suitable fastener means such as a set screw received in threaded bore 22.66 accessible through bore 22.68 in pusher element 22.32 (FIGS. 15 and 18). A boss section 22.70 is provided on the back side of print head support 22.44 and is formed with a seat 22.72 for reception of a magnet 22.74. Another magnet 22.76 is received in seat 22.78 formed on pusher element 22.32. As best seen in FIG. 13, the magnets are aligned with and in close magnetic coupling with each other when the print head support is in the vertical (as seen in the Figure) printing orientation. The magnetic coupling stabilizes the print head and eliminates any loose motion with concomitant blurring of the printed characters.

Adjustable bumpers may be conveniently placed on wall portions 22.24, 22.26 to cushion the movement of carrier 22.28 at its two opposite extremities.

Wall portion 22.80 extending between side walls 22.12 is provided with a suitable threaded bore mounting an attachment clamp 22.82 which can conveniently clamp a bracket against the rear surface portions 22.84 of side walls 22.12, for example bracket 94 of carriage 20 of FIG. 5*a*.

Figures 22A, 22B, 22C, 22D, 22E, 22F, 22G, 22H, 22I, 22J:
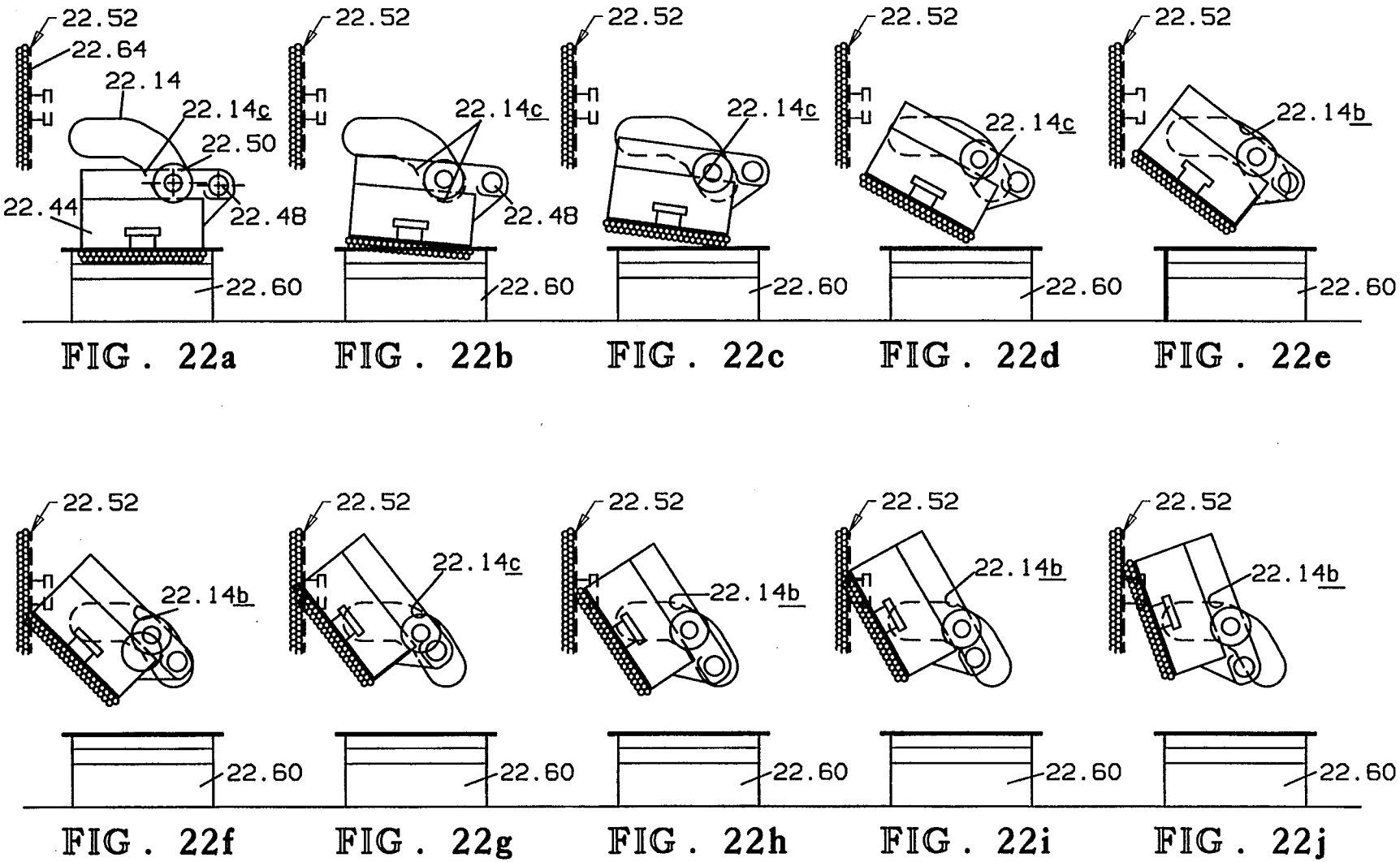
Figures 22K, 22L, 22M, 22N, 22O:
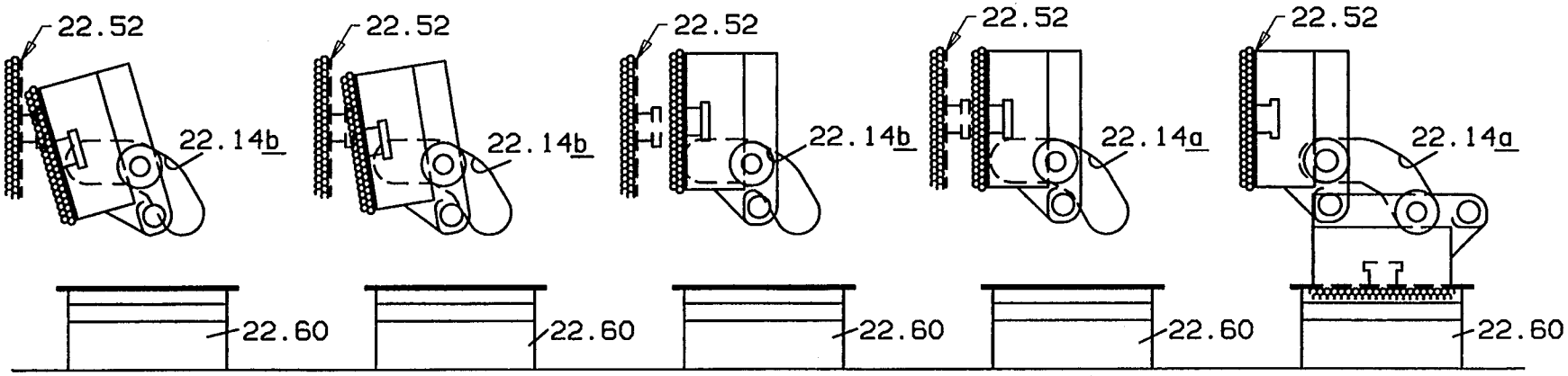

With particular reference to FIGS. 22*a*–22*o*, print head 22.64 is shown in dashed lines at the printing station as a reference point. In FIG. 22*a* the ink head is shown at the ink replenishing station with cam followers in the lowermost portion of the cam track. As the piston strokes outwardly the print head support is forced to pivot about 22.48 with support 22.44 moving up track portion 22.14*c*. It will be noticed in FIG. 22*a* that the center of cam followers 22.50 is slightly above the pivotal connection 22.48 as well as the longitudinal axis of cylinder rod 22.36 so that the follower is already over center when a force from the piston is applied which causes the follower to smoothly roll up the track. The lower track portion 22.14*c* extends at a first angle, 60 degrees, relative to the longitudinal axis of cylinder rod 22.36 resulting in a first velocity portion of travel of print head support 22.44 and the beginning of pivotal movement (FIGS. 22*b*–22*d*). Second track portion 22.14*b* extends at a second angle, 30 degrees, relative to the longitudinal axis of cylinder rod 22.36 resulting in a second, faster velocity portion of travel and the completion of pivotal motion to a printing orientation 90 degrees relative to the ink replenishing orientation (FIGS. 22*e*–22*l*). The third track portion 22.14*a* extends parallel to the longitudinal axis of cylinder rod 22.36 resulting in a third, relatively fastest velocity portion of travel during the printing portion of the stroke. During this portion magnets 22.74, 22.76 are in close magnetic coupling securely stabilizing the printing head support so that clean, crisp printed characters can be applied to the work piece.

Once the printing stroke has taken place the air cylinder is retracted and the reverse action of the print head support takes place. As the cylinder rod is retracted the cam followers are forced down portion 22.14*b* of the track causing the two magnets to disengage, the followers continuing down to the bottom of the cam slot with the print head assuming a horizontal position (as seen in the Figure) at the ink replenishing station where its printing type face picks up ink for the next printing cycle.

Whereas conventional print heads have a relatively short useful life due to the impacting forces on the loose linkages, for example only a few hundred thousand cycles, a print head system made in accordance with the invention has a useful life several times as long as well as being quiet and providing exceptionally sharp and well defined printed characters. Further, the print head system made in accordance with the invention, due to its stable motion is capable of running significantly increased cycles per unit of time compared to conventional print heads.

Although the invention has been described with respect to specific, preferred embodiments thereof, many variations and modifications will become apparent to those skilled in the art. It is the intent that the appended claims be interpreted as broadly as possible in view of the prior art, to include all such variations and modifications.

What is claimed:

1. Print head apparatus movable in an operational cycle along a path between a first ink replenishing station adjacent an ink supply and a second printing station adjacent a work piece comprising;

a housing having side walls, track means formed in the side walls, ink supply means, a carriage movably mounted to slide with rectilinear motion between a protracted and a retracted position, a pusher element fixed to the carriage and movable therewith and immovable relative to the carriage, the pusher element extending downwardly from the carriage to a free distal end portion, means attached to the pusher element to move the pusher element and carriage between the protracted and retracted positions each operational cycle, a print head having a body pivotably mounted to the pusher element adjacent the free distal end portion, follower means attached to the body and extending laterally thermally and being received in the track means, the print head having a front print surface and an opposed back surface, the front print surface being disposed at a first angular orientation at the printing station when the pusher element and the carriage are in the protracted position and being disposed at a second angular orientation different from the first angular orientation at the ink replenishing station when the pusher element and the carriage are in the retracted position, a pair of housings, an upper and a lower tube extending between and in communication with the interior of the housings, the tubes having longitudinal axes parallel with one another, the upper tube being formed of non-magnetic material, a first magnet movably disposed within one of the cubes, an elongated element attached to the first magnet and extending therefrom through the said one of the tubes into a housing and through the other tube into the other housing and back to the first magnet and attached thereto, a carriage being slidably mounted on the said one of the tubes and being adapted to slide between the housings, means to selectively move the elongated element so that the first magnet can be positioned to any selected transverse location within the said one of the tubes between the housings, and a second magnet mounted on the carriage in magnetic coupling with the first magnet whereby the carriage will move in response to movement of the first magnet, the print head being mounted on the carriage for movement therewith.

2. Print head apparatus according to claim 1 in which the elongated element is a timing belt.

3. Print head apparatus according to claim 1 including first and second proximity switches mounted in one of the tubes adjacent respective housings and further including position sensing means mounted on the elongated element the position of which is sensed by the proximity switches when in alignment therewith.

4. Print head apparatus movable in an operational cycle along a path between a first ink replenishing station adjacent an ink supply and a second printing station adjacent a work piece comprising:

a housing having side walls, track means formed in the side walls, ink supply means, a carriage movably mounted to slide with rectilinear motion between a protracted and a retracted position, a pusher element fixed to the carriage and movable therewith and immovable relative to the carriage, the pusher element extending downwardly from the carriage to a free distal end portion, two shafts mounted in the housing extending parallel to one another, the carriage having bearings receiving respective shafts to slide thereon, means attached to the pusher element to move the pusher element and carriage between the protracted and retracted positions each operational cycle, comprising a fixedly mounted pneumatic cylinder having a rod movable in a direction parallel to the two parallely extending shafts, the rod attached to the free distal end portion of the pusher element, a print head having a body pivotably mounted to the pusher element adjacent the free distal end portion, follower means attached to the body and extending laterally therefrom and being received in the track means, the print head having a front print surface and an opposed back surface, the front print surface being disposed at a first angular orientation at the printing station when the pusher element and the carriage are in the protracted position and being disposed at a second angular orientation different from the first angular orientation at the ink replenishing station when the pusher element and the carriage are in the retracted position, movement of the print head, when the carriage is proximate to the protracted position, being rectilinear both toward and away from the protracted position.

5. Print head apparatus according to claim 4 including magnetic means coupling the print head to the pusher element only during rectilinear movement.

6. Print head apparatus according to claim 5 in which the magnetic means comprises a first magnet mounted in the print head and a second magnet mounted on the pusher element.

7. Print head apparatus according to claim 4 in which the track means comprises first and second tracks aligned with each other and the follower means comprise a pair of roller elements received in respective tracks and being adapted to roll therein.

8. Print head apparatus according to claim 4 in which the track means has a section extending along a straight line parallel to the said direction so that the print head will move with higher velocity in the rectilinear portion of movement.

9. Print head apparatus movable along a path between a first ink replenishing station adjacent an ink supply and a second printing station adjacent a work piece comprising:

a housing having side walls, track means formed in the side walls, a carriage movably mounted to slide with rectilinear motion between a protracted and a retracted position, a pusher element fixed to the carriage and movable therewith, the pusher element extending downwardly from the carriage to a free distal end portion, means attached to the pusher element to move the pusher element and carriage between the protracted and retracted positions, a print head having a body pivotably mounted to the pusher element adjacent the free distal end portion, follower means attached to the body and being received in the track means, the print head having a front print surface and an opposed back surface, the front print surface being disposed at a first angular orientation at the printing station when the pusher element and the carriage are in the protracted position and being disposed at a second angular orientation different from the first angular orientation at the ink replenishing station when the pusher element and the carriage are in the retracted position, and means to magnetically couple the print head to the pusher element when the front print surface is in the first angular orientation and to magnetically decouple the print head from the pusher element when the front print surface is not in the first angular position.

10. Print head apparatus according to claim 9 in which the means to magnetically couple the print head to the pusher element includes a first magnet mounted on the print head body and a second magnet mounted on the pusher element.

* * * * *